United States Patent [19]

Pedersen et al.

[11] Patent Number: 4,796,170

[45] Date of Patent: Jan. 3, 1989

[54] DISPLAY UNITS

[76] Inventors: Kenneth M. Pedersen, 165 Browns Bay Road, Browns Bay; Alan M. Filmer, 88 Ti Rakau Drive, Pakuranga, both of Auckland, New Zealand

[21] Appl. No.: 18,413

[22] Filed: Feb. 25, 1987

[30] Foreign Application Priority Data

Apr. 14, 1986 [NZ] New Zealand ..... 215814

[51] Int. Cl.[4] ..... F21V 7/00

[52] U.S. Cl. ..... 362/308; 40/564; 362/223

[58] Field of Search ..... 362/97, 224, 305, 329, 362/330, 337, 308, 223; 40/615, 564, 582, 367

[56] References Cited

U.S. PATENT DOCUMENTS

| | | | |
|---|---|---|---|
| 1,882,647 | 10/1932 | Kanolt | 362/97 |
| 2,515,844 | 7/1950 | Trost | 362/224 |
| 3,153,293 | 10/1964 | Clarkson et al. | 40/367 |
| 3,314,180 | 4/1967 | Porter | 40/615 |

*Primary Examiner*—Henry A. Bennet

*Attorney, Agent, or Firm*—Holman & Stern

[57] ABSTRACT

A display unit has a light source, an indicia bearing diffusion sheet or transparent having masked, transparent and translucent areas and a series of refractive layers are placed over the diffusion sheet. On the light being lit, and the light rays passed outwardly through the transparent or translucent areas and through the refractive layers, the indicia are each surrounded with a penumbra of light which gives a three dimensional effect to the display of the indicia.

5 Claims, 2 Drawing Sheets

DISPLAY UNITS

This invention relates to display units.

It is an object of the present invention to provide a display unit which will at least provide the public with a useful choice.

Accordingly, the invention consists in a display unit comprising a light box cottaining a source of illumination, one surface of said light box comprising a sheet of material which in use will transmit light from the interior of the light box outwardly, indicia bearing means including masked areas and areas selected from translucent and transparent areas mounted within the light box and a plurality of layers of refracting light transmitting material interposed between said sheet of material and said indicia bearing means the construction and arrangement being such that on the light source being illuminated said indicia will be displayed through said layers of refracting material and said sheet of material in a manner such that the indicia are displayed with a surrounding penumbra of light which gives a three dimensional effect to the display of said indicia.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

Figure 1:
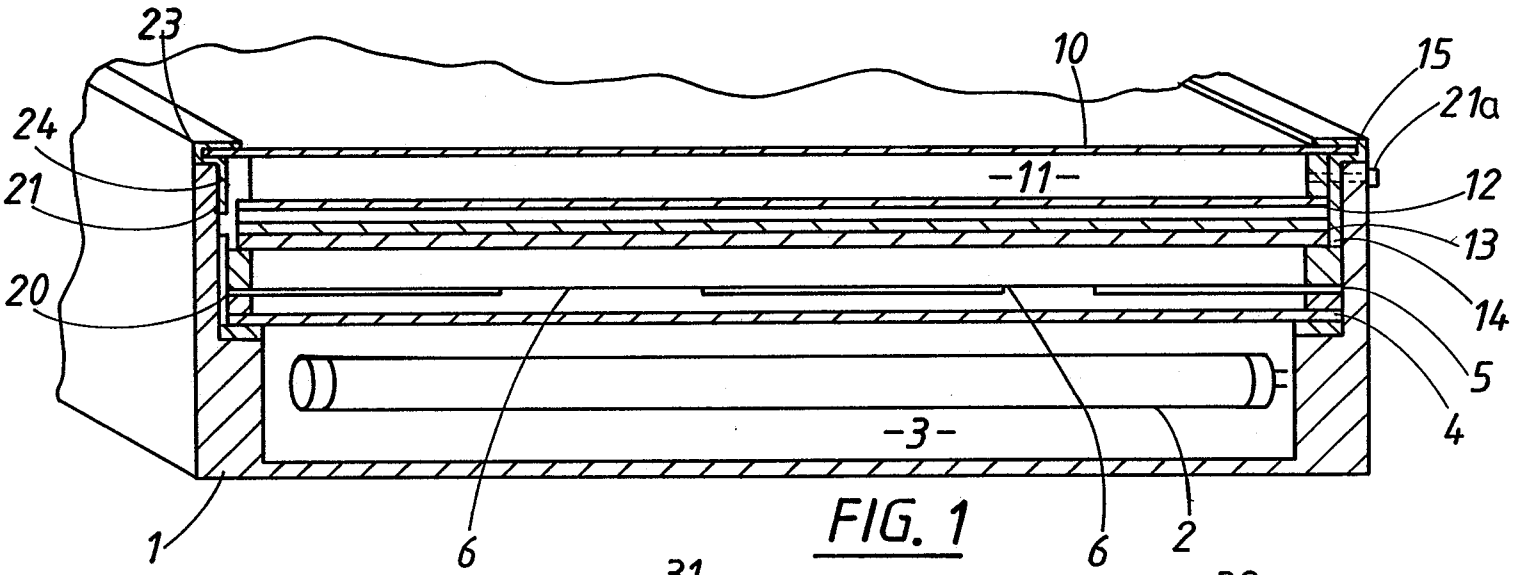
Figure 2:
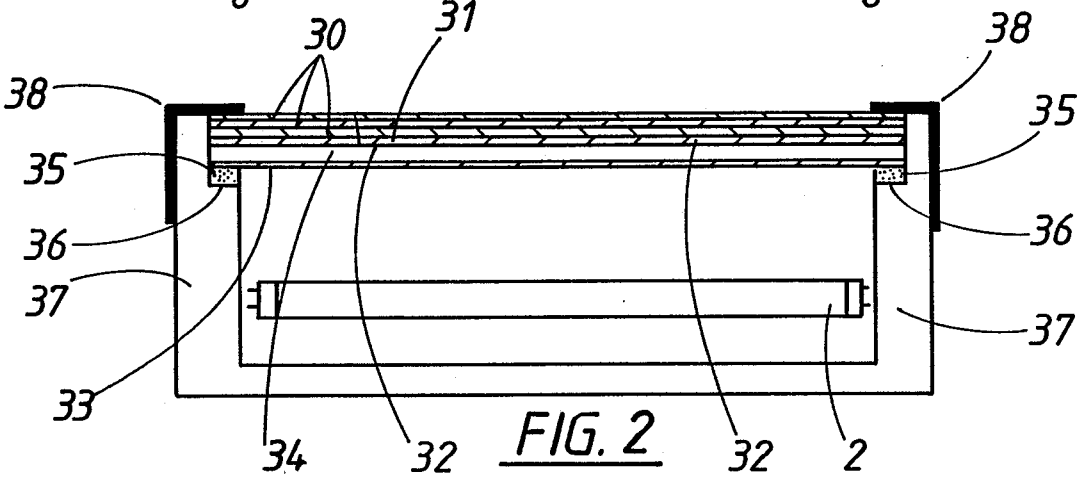
Figure 3:
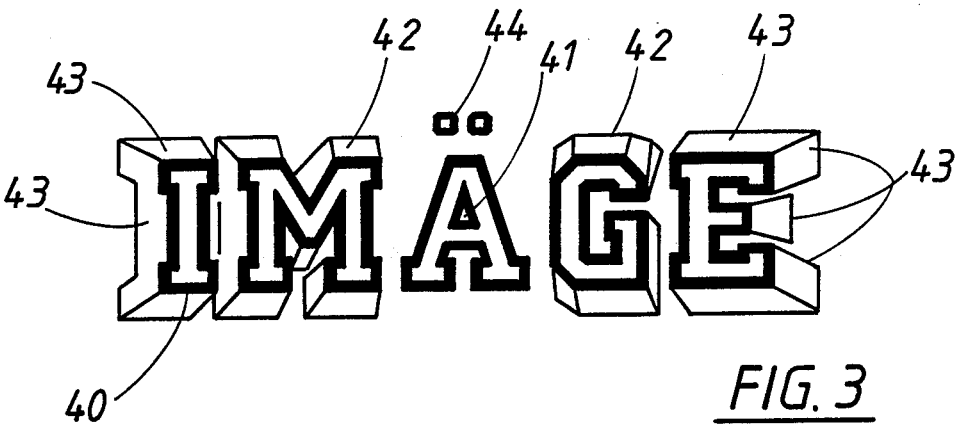
Figure 4:
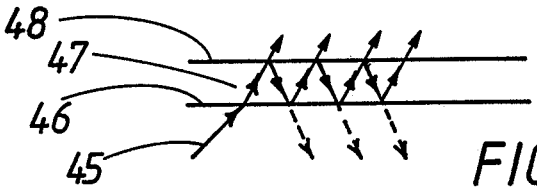
Figure 5:
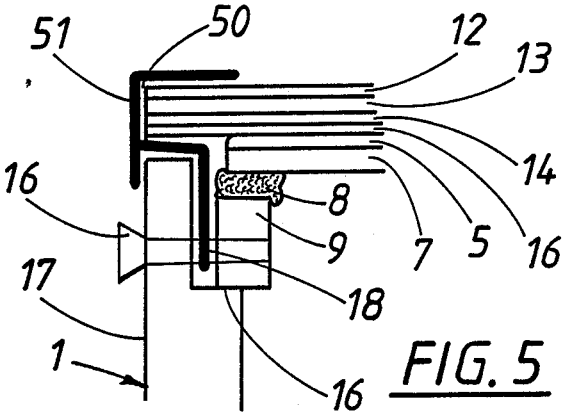

One preferred form of the invention will now be described with reference to the accompanying drawings in which:

FIG. 1 is a partly diagrammatic perspective sketch of a light box constructed according to the invention, FIG. 2 is a similar view of an alternative construction, FIG. 3 is an elevational view of a typical individual display produced by the light box, FIG. 4 is a diagrammatic view showing reflective and refractive effects produced by elements in the light box, and FIG. 5 is a partly diagrammatic sectional view of part of a modified form of light box.

Referring to the drawings a light box 1 is provided having a light source, e.g. one or more fluorescent tubes 2 in a lower compartment 3. The lower compartment is separated by a diffusion sheet and/or photographic transparency 7, the diffusion sheet being for example frosted glass or tracing paper or a similar sheet which will give a diffused light effect. A mirror 5 is disposed above the diffusion sheet 4 and the mirror 5 has areas 6 thereof which are not silvered e.g. parts from which the silvering of the mirror has been removed e.g. by etching. Alternatively such areas may be masked before silvering is effected and the mask then peeled off to leave the areas 6 as translucent or preferably transparent areas. The diffusion or transparency is arranged so that desired portions thereof bear indicia which may be viewed through the transparent areas 6 of the mirror 5.

An upper sheet of material 10 is preferably of a reflective nature while yet passing some light and is such that light from the ambient surroundings outside the light box will be reflected from the sheet material 10 but light will be transmitted from the interior 11 of the light box. Preferably that sheet material comprises grey MIRROPANE as manufactured by Libby-Owens Ford of the United States of America. It is a surface coated e.g. chromium coated glass which has the attributes desirable for this invention. Although the coated or reflective side may be faced outwardly, it is preferably faced inwardly. Alternatively a partially silvered mirror material may be used but the MIRROPANE material is preferred.

Interposed between the mirror 5 and the sheet material 10 are a plurality of refracting layers (of which the sheet 10 may form one layer) which preferably comprises a plurality of sheets of coloured or transparent glass 12, 13 and 14 but a plastics material e.g. a methacrylate resin (perspex) or other acrylic material may be used. The sheets of glass may be in contact with each other as is shown by sheets 13 and 14 or may be spaced apart with an air space 15 between them as shown between sheets 12 and 13. Any desired number of refracting layers may be provided but we have found that 4 to 6 sheets of glass of 2 to 5 mm thickness laid with their surfaces contacting provide a satisfactory result.

The sheets are held in place and suitably spaced by spacers 20 and 21 and these spacers are held in position by screws such as screws 22 engaging the upper spacer 21. A metal or plastic surround 23 is provided having a flange 24 through which the screws 21*a* penetrate so that the surround 23 holds the upper sheet of material 10 in position.

The use of this construction is as follows.

On the light source being illuminated, light passes through the diffusion sheet or transparency through the gaps 6 and through the refractive layers 12 to 14 and then through the sheet of material 10. As a result of the refractive layers and because of reflections occurring off the surfaces of such refractive layers an image of the indicia seen through the transparent area 6 will have multiple reflectings which pass back to the mirror surface 5 to give a penumbral effect which may be seen through the surface material 10 to give a solid or bar three dimensional effect to any such indicia.

This three dimensional effect is illustrated in FIG. 3 in which the indicia is shown in heavy outline 40 to spell out the word IMAGE. The figure is drawn as though the eye of a viewer is directly in front of the letter A, which accordingly does not shown material refractive or reflective images. Should the viewer move his eye slightly from side to side, an effect of a tunnel is seen in the space 41 of the letter A. As shown in the drawing, the further the indicia are from the central letter A, the greater the refractive and reflective effect of a three dimensional solid or bar is given as indicated by the areas 42 on the letters M and G and the areas 43 on the letters I and E. The umlaut 44 over the letter is intended as a focal point. It is believed that the effect is based on reflective and refractive effects as shown diagrammatically in FIG. 4, where a single incident ray 45 is refracted and reflected at surface 46 and the refracted ray 47 is in turn reflected and perhaps refracted further depending on whether there is glass to glass or glass to air contact at surface position 48, the process being repeated at successive surface junctions until the ray emerges as a series of refracted and reflected rays, only one set of which emanating from ray 45 through glass sheet 49 is shown giving a broadening effect to the incident ray and by multiplication of the incident rays and of the surface reflecting and refracting rays, giving the three dimensional effect shown in FIG. 3. Of course losses due to reflection and other transmission losses result in fading and eventual extinction of the successively reflected and refracted rays but without deleteriously affecting the desired and attained result.

Thus the technique gives the effect of a solid block of layered light on a mirror and gives a single image on the mirror when not backlit.

It will be seen that by the foregoing construction, at least in the preferred form, a very desirable optical effect is given which has advantages in displays used e.g. in the advertising industry.

In FIG. 2 an alternative arrangement is shown in which layered sheets 30 and 31 of glass or other transferred material are provided, the lowest sheet 31 being etched to provide "windows" 32. A diffusion sheet 33 is placed below a partially or fully silvered mirror 34 which is positioned between the sheets 31 and 33. The assembly is mounted on compression rubber strips 35 resting on rebate bases 36 on the sides 37 and the assembly is held in position by the angle members 38.

In a further modification, the windows 32 are omitted and a print e.g. a screen print of indicia with any suitable combination of opaque, translucent and transparent portions is placed on the outer or inner surface of the outer layer of the layers 30 of glass.

In a still further modification shown in FIG. 5, the glass sheets 12, 13, 14 and 16 are fixed in a channel 50 in a frame 51, the mirror 5 and transparency 7 are supported on a resilient support 8 in turn supported by a strip 9 on a ledge 16. A screw 17 passes through part of the wall 17 of box 1 at flange 18 on the frame 51 and is threaded into the strip 9; his construction enables the glass sheets to be removed as a whole e.g. for changing the etched mirror 5.

What is claimed is:

1. A display unit comprising a light box containing a source of illumination, one surface of said light box comprising a sheet of material which in use will transmit light from the interior of the light box outwardly, indicia bearing means including masked areas and areas selected from translucent and transparent areas mounted within the light box between the source of illumination and said sheet, and a plurality of layers of refracting light transmitting material with parallel sides interposed between said sheet of material and said indicia bearing means, the construction and arrangement being such that on the light source being illuminated said indicia will be displayed through said layers of refracting material and said sheet of material in a manner such that the indicia are displayed with a surrounding penumbra of light which gives a three dimensional effect to the display of said indicia.

2. A display unit as claimed in claim 1 wherein said sheet of material reflects light directed towards the sheet of material from exterior of the light box.

3. A display unit as claimed in claim 1 wherein said indicia bearing means includes a mirror over a light transmission varying means selected from a diffusion sheet and a photographic transparency said mirror having gapped areas not silvered so that said varying means will be viewed through the gapped areas in the mirror.

4. A display unit as claimed in claim 1 wherein said refracting layers comprise a pluraltiy of individual sheets of transparent material positioned with faces of individual sheets contacted against the next sheet.

5. A display unit as claimed in claim 1 wherein said sheet of material and said plurality of layers of refracting material are held in a channel in a surrounding frame, said frame being removably held in said light box by fasteners.

* * * * *